US008319156B2

(12) United States Patent
Borwick, III et al.

(10) Patent No.: US 8,319,156 B2
(45) Date of Patent: Nov. 27, 2012

(54) SYSTEM FOR HEATING A VAPOR CELL

(75) Inventors: Robert L. Borwick, III, Thousand Oaks, CA (US); Jeffrey F. DeNatale, Thousand Oaks, CA (US); Chialun Tsai, Thousand Oaks, CA (US); Philip A. Stupar, Oxnard, CA (US); Ya-Chi Chen, Simi Valley, CA (US)

(73) Assignee: Teledyne Scientific & Imaging, LLC

( * ) Notice: Subject to any disclaimer, the term of this patent is extended or adjusted under 35 U.S.C. 154(b) by 447 days.

(21) Appl. No.: 12/645,427

(22) Filed: Dec. 22, 2009

(65) Prior Publication Data

US 2011/0147367 A1 Jun. 23, 2011

(51) Int. Cl.
*H05B 3/02* (2006.01)

(52) U.S. Cl. ..... 219/482; 219/552

(58) Field of Classification Search ..... 219/482, 219/552

See application file for complete search history.

(56) References Cited

U.S. PATENT DOCUMENTS

2003/0116559 A1* 6/2003 Park ..... 219/543
2008/0078759 A1* 4/2008 Wnek et al. ..... 219/730

OTHER PUBLICATIONS

Lutwak, R. et al., "The Chip-Scale Atomic Clock—Recent Development Progress", *Proceedings of the 34th Annual Precise Time and Time Interval Systems Applications Meeting*, pp. 1-12, San Diego, California, Dec. 2-4, 2003.

Kitching, J. et al., "Chip-Scale Atomic Clocks at NIST", 2005 *NCSL International Workshop and Symposium*, Aug. 7, 2005.

Kitching, J. et al., "Chip-Scale Atomic Frequency References: Fabrication and Performance", 19th *European Frequency and Time Forum*, Besançon, France, p. 575-580, Mar. 21, 2005.

Kitching, J. et al., "Microfabricated Atomic Clocks", *Presentation at 18th IEEE International Conference on Micro Electro Mechanical System*, O-7803-8732-5/05, Jan. 30-Feb. 3, 2005, p. 1-7.

Knappe, S. et al., "Atomic vapor cells for chip-scale atomic clocks with improved long-term frequency stability", *Optics Letters*, Sep. 15, 2005, vol. 30, No. 18, p. 2351-2353.

Youngner, D.W. et al., "A Manufacturable Chip-Scale Atomic Clock", *Presentation at 14th International Conference on Solid-State Sensors, Actuators and Microsystems*, Lyon, France, Jun. 10-14, 2007, p. 39-44.

Donley, Elizabeth, "Chip-Scale, Microfabricated Atomic Clocks", *International Telecom Sync Forum*, Munich, Germany, Nov. 4, 2008.

DeNatale, J.F. et al., "Compact, Low-Power Chip-Scale Atomic Clock", *IEEE ION/PLANS* 2008, Monterey, CA, May 5-8, 2008.

* cited by examiner

*Primary Examiner* — Huan Hoang

(57) ABSTRACT

A vapor cell includes an interrogation cell in a substrate, the interrogation cell having an entrance window and an exit window, and a first transparent thin-film heater in thermal communication with the entrance window. The transparent thin-film heater has a first layer in communication with a first pole contact at a proximal end of the heater and a layer coupler contact at a distal end, a second layer in communication with a second pole contact at the proximal end, and the second layer electrically coupled to the layer coupler contact at the distal end. An insulating layer is sandwiched between the first and second layers. The insulating layer has an opening at the distal end to admit the layer coupler contact and to insulate the remainder of the second layer from the first layer. The first and second pole contacts are available to complete an electric circuit at the proximal end, with magnetic fields for each of the first and second layers oriented in opposing directions when a current is applied through the circuit.

20 Claims, 5 Drawing Sheets

SYSTEM FOR HEATING A VAPOR CELL

This invention was made with Government support under Contract No. N66001-02-C-8025 awarded by the Space and Naval Warfare Systems Center. The Government has certain rights in this invention.

BACKGROUND OF THE INVENTION

1. Field of the Invention

This invention relates to electric heaters used in microsystems, systems, and more particularly to chip-scale heaters used for vapor cell interrogation systems.

2. Description of the Related Art

Advances in microelectromechanical systems (MEMS) have enabled a variety of miniaturized and chip-scale atomic devices used in, for example, gyroscopes, magnetometers and chip-scale atomic clocks (CSAC). With reduced system dimensions come many advantages, including lower operating power and reduced manufacturing cost for the finished device. Of primary importance in many of these MEMS applications, is an atomic vapor cell for use as a frequency-defining element, rather than traditional quartz-crystal resonators, for improved frequency stability.

As is typical for atomic vapor cells during their manufacture, the vapor cell is charged with a sample material that later produces an interrogation gas during heating and subsequent operation. Common sample material examples for atomic vapor cells include rubidium (Rb) and cesium (Cs). The vapor cell is permanently sealed after charging, often using anodic bonding between a silicon substrate containing an interrogation cell enclosing the sample material and a transparent window through which the gas is interrogated after heating. Heaters are typically used to maintain suitable vapor pressure of the sample material in the vapor cell and can be positioned adjacent the gas interrogation cavity of the vapor cell to heat the enclosed sample material. Because the solid form of sample materials such as rubidium and cesium tend to migrate and condense at the coldest portions of the vapor cell, window heaters may be placed directly on the entrance and/or exit windows of the vapor cell to create a suitable thermal profile for reduction of solid sample material buildup over the aperture portion of such windows. Typical window heaters may consist of wire heaters spaced adjacent the aperture portion of the windows or transparent window heaters that may or may not cover the aperture, itself.

SUMMARY OF THE INVENTION

In one embodiment, a vapor cell system is disclosed that includes an interrogation cell in a substrate, the interrogation cell having an entrance window and an exit window and a first multi-layer transparent thin-film heater in thermal communication with the entrance window. To facilitate description of the system, the transparent thin-film heater is described as having proximal and distal ends. A first layer of the heater is in communication with a first pole contact at the proximal end, and a layer coupler contact at the distal end. A second layer of the heater is in communication with a second pole contact at the proximal end, the second layer electrically coupled to the layer coupler contact at the distal end, and an insulating layer is sandwiched between the first and second layers. The insulating layer has an opening at the distal end to admit the layer coupler contact and to insulate the remainder of the second layer from the first layer. The first and second pole contacts are available to complete an electric circuit at the proximal end, with electric currents (and hence magnetic fields) for each of the first and second layers oriented in opposing directions when a current is applied through the circuit.

A heater method is also disclosed that includes driving a current through folded and directionally-opposite current paths in the transparent thin-film heater and heating an entrance window of a vapor cell with heat generated from the multi-layer thin-film heater so that the folded and opposing current paths reduce the magnetic field from what would otherwise exist in a vapor cell heater without the folded and stacked configuration of the multi-layer thin-film heater.

BRIEF DESCRIPTION OF THE DRAWINGS

The components in the figures are not necessarily to scale, emphasis instead being placed instead upon illustrating the principals of the invention. Like reference numerals designate corresponding parts throughout the different views.

DETAILED DESCRIPTION OF THE INVENTION

In many vapor cell applications, such as CSAC, the device operation requires a stable magnetic field. Field perturbations caused by the time-varying currents in resistive heaters can degrade device performance. A stacked, multi-layer thin-film heater is disclosed for use in combination with a vapor cell to reduce unwanted magnetic fields associated with prior art thin-film heaters and to facilitate migration of sample material condensation away from the optical aperture. In one embodiment, the heater has a plurality of stacked thin-film layers in serial communication to wrap respective current flows during operation to reduce its external magnetic field.

In addition to the issues with thermal profiles, magnetic fields created by the heaters are another concern.

Figure 1:
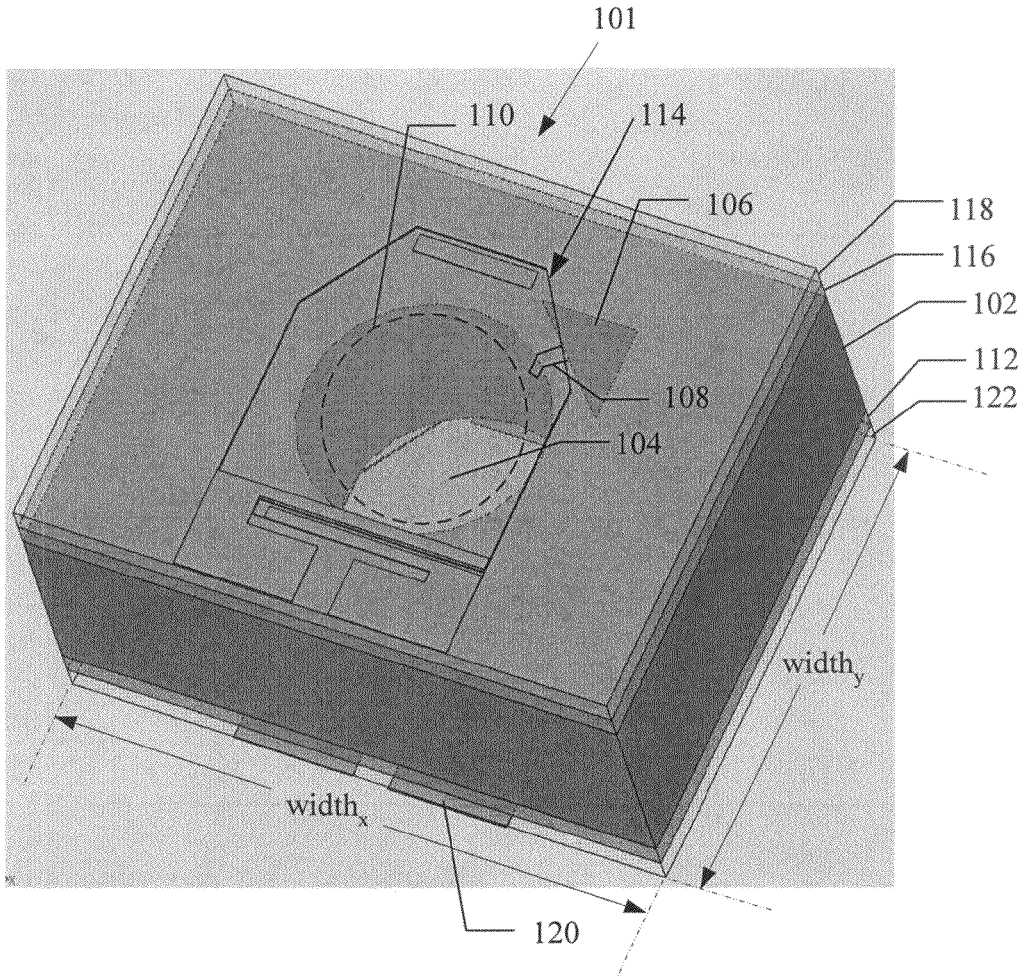
FIG. 1 is one embodiment of a vapor cell system having a side reservoir cell for receipt of a sample material for vapor cell charging, and including transparent window heater disposed over an included gas interrogation cell.

FIG. 1 illustrates one embodiment of a vapor cell 101 that uses as its foundation a substrate 102, preferably silicon crystal. An interrogation cell 104 having a generally circular cross section and inner wall(s) 105 is formed extending through opposite sides of the substrate 102. The interrogation cell 104 is in vapor communication with a reservoir cell 106, preferably through a trench 108. The reservoir cell 106 receives a sample material to charge the vapor cell for later gas interrogation, in accordance with one embodiment described, below. The reservoir cell 106 also provides a place for sample material, preferably rubidium (Rb) or cesium (Cs), that is not in vapor phase to condense on the coolest part of the vapor cell, outside an optical aperture 110 of the interrogation cell 104, and provides a place outside of the optical aperture for any non-volatile Rb oxides and hydroxides residual from cell filling. The reservoir cell 106 extends partially or fully into the substrate 102 and, although illustrated as having a generally triangular cross section, may be formed into other shapes to better accept the sample material. For example, the reservoir cell 106 may be formed into a rectangular or circular cross section in order to facilitate introduction of the sample material.

An exit window, preferably a transparent window 112, is coupled to the substrate 102 on a side opposite from the reservoir cell 106. The transparent window 112 is preferably formed from borosilicate glass, although other materials may be used to both seal the interrogation chamber 104 and to provide suitable transparency for later electromagnetic (EM) interrogation of the vapor cell 101. If formed of borosilicate glass, such coupling is preferably accomplished by anodic bonding, with the transparent window 112 covering the interrogation chamber 104 on one side of the substrate. Other bonding techniques may be used to bond the window to the substrate 102, however, such as through the use of glass frit, metal to metal thermal compression, solder or other bonding materials. A transparent entrance window 116, preferably borosilicate glass, is coupled to the substrate 102 on a side opposite from the transparent exit window 112, such as by anodic bonding, to vapor seal the reservoir cell 106 and interrogation cell 104 from the external environment.

A stacked, multi-layer thin-film heater 114 is in thermal communication with the transparent entrance window 116 at the optical aperture 110 of the interrogation cell 114 through a transparent heater substrate 118. Preferably, the heater 114 heats the entrance window 116 uniformly. In an alternative embodiment, the heater 114 is configured to heat the optical aperture 110 annularly, such as if the heater was formed with annular, rather than, solid rectangular, stacked thin-film layers. Similarly, a second multi-layer, thin-film heater 120 is in thermal communication with the transparent exit window 112 at an exit optical aperture (not illustrated) of the interrogation cell 114 through a second transparent heater substrate 122. Each of the transparent heater substrates (116, 122) are preferably composed of borosilicate glass, although other suitably transparent and heat-resistant materials may be used. The thin-film heater 114 does not cover the reservoir cell 116 to facilitate migration of sample material condensation away from the optical aperture 110.

In one vapor cell designed for use in a chip-scale atomic clock (CSAC) device and using a 2 mm silicon wafer thickness, the interrogation cell diameter is preferably 2 mm and the various other elements of the vapor cell have the approximate thicknesses and widths listed in Table 1.

TABLE 1

| | Thickness (mm) | $Width_x \times Width_y$ (mm) |
|---|---|---|
| Heater substrate (122) | 0.2-0.5 | 4.25 × 5 |
| Exit transparent window (112) | 0.2-0.4 | 4 × 5 |
| Substrate (102) | 2 | 4 × 5 |
| Entrance transparent window (116) | 0.2-0.4 | 4 × 5 |
| Heater substrate (118) | | 4 × 5 |
| Reservoir cell (106) | 1-2 (depth) | 1 (base) 1 (height) |
| Interrogation cell (104) | 2 (diameter) | NA |

Figure 2:
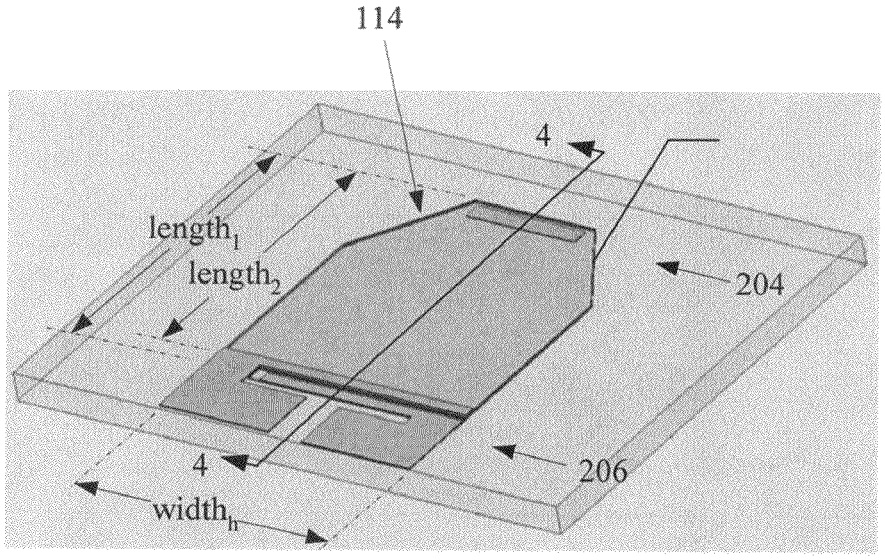
FIG. 2 is a perspective view of the transparent window heater first illustrated in FIG. 1.
Figure 3:
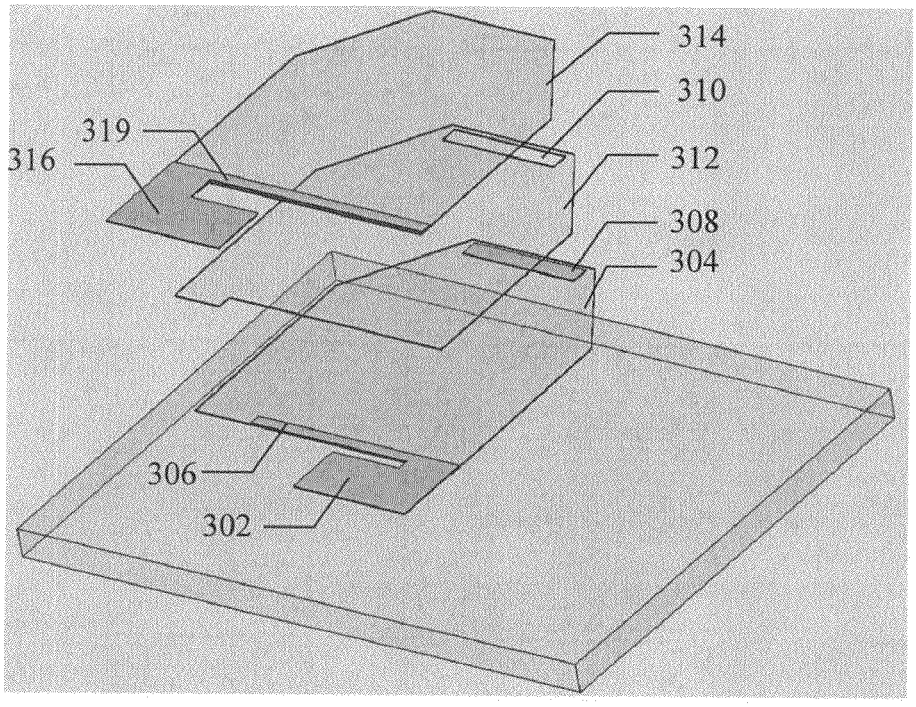
FIG. 3 is an exploded prospective view of the transparent window heater illustrated in FIG. 2.

FIGS. 2 and 3 are assembled and exploded perspective views, respectively, of the vertically stacked and multi-layer thin-film heater used on the vapor cell illustrated in FIG. 1. Preferably, the heater 114 is formed of multiple thin-film zinc-oxide (ZnO) or Indium Tin Oxide (ITO) layers electrically coupled in serial fashion, each layer substantially separated by an insulator, on the transparent heater substrate 118. More particularly, a first pole pad 302 is coupled to a first thin-film layer 304 through a first pole distribution strip 306 at a proximal end 204 of the heater 114. At a distal end 206 of the heater 114, a coupler contact 308 is coupled to the first thin-film layer 304 and extends through a slot or other opening 310 established in an insulating layer 312 disposed on the first thin-film layer 304. A second layer 314 is seated on the insulating layer 312 and is electrically coupled to the coupler contact 308, with the remainder of second layer 314 insulated from the first thin-film layer 304 by the insulation layer 312 sandwiched between them. A second pole pad 316 is coupled to the second layer 314 through a second pole distribution strip 319. The first and second pole distribution strips (306, 319) extend along proximal edges of their respective layers to promote more uniform current distribution, and hence temperature, through their respective thin-film layers in view of the relative location of the coupler contact (308). The pole pads (302, 316), pole distribution strips (306, 319) and coupler contact (308) are preferably formed of metal such as gold (Au), but may be formed with any suitable metal or other conductor. The insulator is a suitable dielectric, such as Silicon Dioxide ($SiO_2$). In an alternative embodiment, the insulator is aluminum oxide or other suitably transparent material. Through the appropriate selection of heater first and second layer (304, 314) thicknesses, widths and lengths, appropriate temperature uniformity and cell heating is provided to the entrance aperture 110 illustrated in FIG. A. The illustrated heater 114 may be utilized on either or both sides of the vapor cell 101 to facilitate migration of sample material condensation away from optical apertures of the vapor cell 101.

Figure 4:
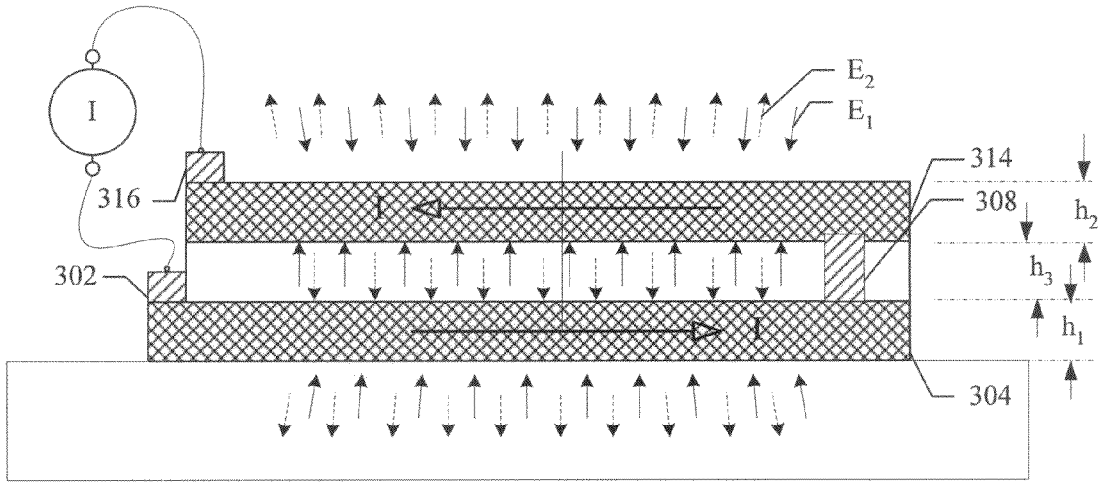
FIG. 4 is a cross-section view of the embodiment shown in FIG. 2 along the line 4-4 and including magnetic field lines.
Figure 5:
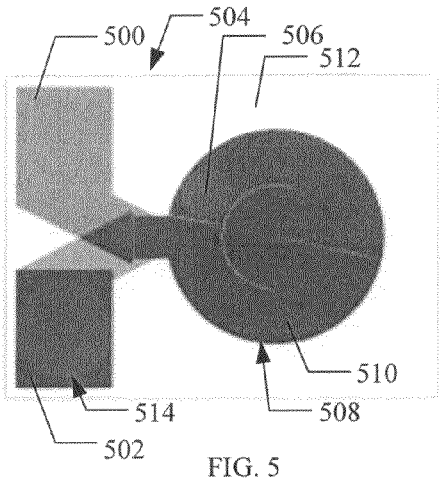
FIGS. 5-10 are plan views illustrating different embodiments of multi-layer thin-film heaters having alternating serpentine and circumferential circuit paths.

FIG. 4 is a cross-section view of the embodiment illustrated in FIG. 2 illustrating magnetic fields generated by individual thin-film layers of the heater, that are each configured to reduce the heater's resultant external magnetic field during operation. When a current source 402 is connected between first and second pole pads (302, 316), current (I) flows from the first pole pad 302, through the first thin-film layer 304 and to the coupler contact 308, with the first layer 304 generating a magnetic field $B_1$. From the coupler contact 308, the current flows through the second thin-film layer 314 to the second pole pad 316, with the second layer 314 producing a magnetic field $B_2$. Because the current I is configured to wrap in directionally-opposite directions, magnetic fields $B_1$ and $B_2$ generally oppose one another. Each positionally adjacent vertically stacked thin-film layer induces a directionally-opposite magnetic field, thereby resulting in a greatly reduced total magnetic field outside of the heater 114 than would otherwise exist without the wrapping configuration. In an alternative embodiment, additional wrapped current paths may be provided, with the sum of the magnetic fields preferably opposing one another to reduce the total summed magnetic field outside of the heater.

In one heater designed for operation at 1-10 V. for use with a rubidium-charged vapor cell as illustrated in FIG. 1, the dimensions and operating parameters of the multi-layer heater are as shown in Table 2.

TABLE 2

| | |
|---|---|
| First layer length ($length_1$) | 2.75 mm |
| First layer thickness ($h_1$) | 500 Å |
| Second layer length ($length_2$) | 2.6 mm |
| Second layer thickness ($h_2$) | 500 Å |
| Heater width ($width_h$) | 2.5 mm |
| Insulator thickness ($h_3$) | 2000 Å |

Figure 6:
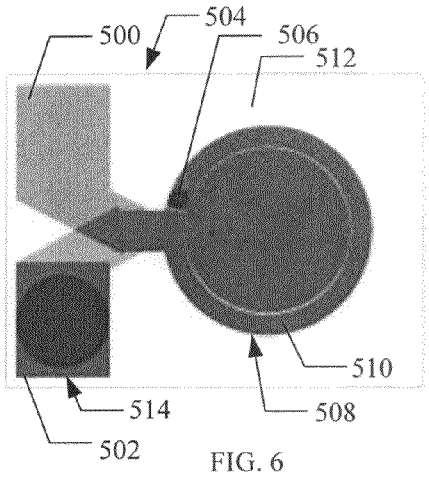
Figure 7:
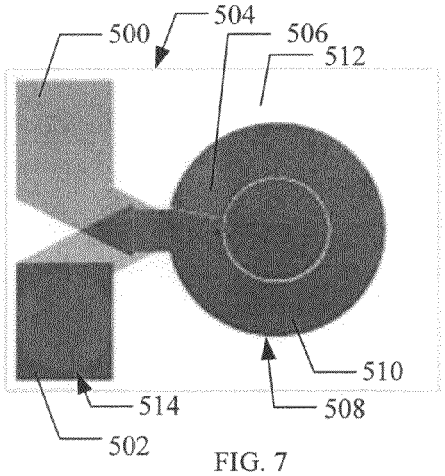
Figure 8:
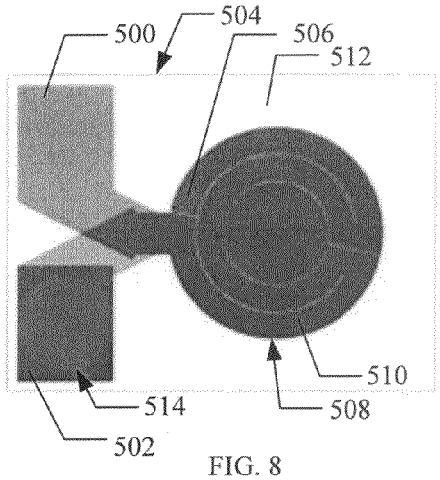
Figure 9:
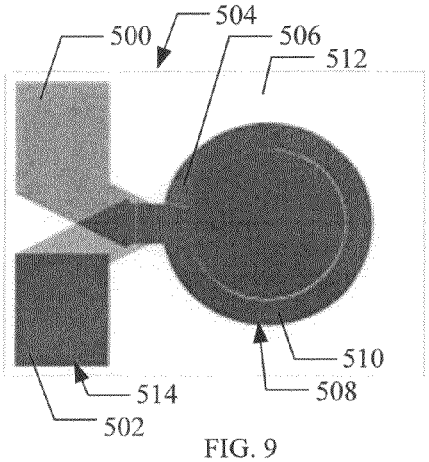
Figure 10:
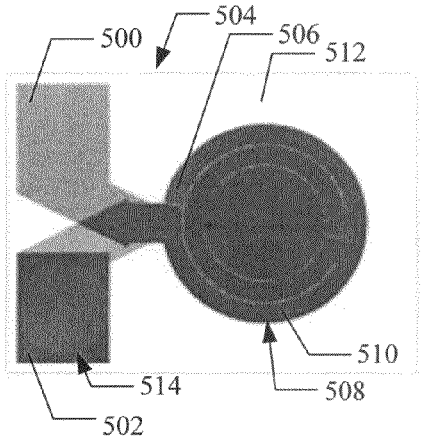

FIGS. 5-10 are top plan views of alternative embodiments of a multi-layer thin-film heater configured with adjacent vertically stacked thin-film layers to induce directionally-opposite magnetic fields in response to a current. Similar to the embodiment illustrated in FIGS. 2 and 3, first and second pole pads (500, 502) are formed on a substrate 504. The first pole pad 500 is electrically connected to a layer coupler contact 506 through a first thin-film layer 508 that either serpentines around (See FIGS. 5, 8 and 10) or circumscribes (FIGS. 6, 7 and 9) a perimeter of the heater. A second thin-film layer 510 is electrically coupled to the layer coupler contact 506, and follows back over the path of the first layer 508, with the remainder of second thin-film layer 510 insulated from the first thin-film layer 508 by an insulation layer 512 sandwiched between them. The second thin-film layer 510 is electrically connected to the second pole pad 502, preferably through a hole 514 etched in the insulator 512. The pole pads (500, 502) and coupler contact (506) are preferably formed of metal such as gold (Au), but may be formed with any suitable metal or other conductor. The insulator is a suitable dielectric, such as silicon dioxide ($SiO_2$). In an alternative embodiment, the insulator is aluminum oxide or other suitably transparent material. Through the appropriate selection of heater first and second layer (500, 502) thicknesses, widths and lengths, appropriate temperature uniformity and cell heating may be provided to an entrance aperture such as those illustrated in FIGS. 1-3. For example, FIG. 5 may have ITO layer thicknesses of 510 Å resulting in 3.6K ohm resistance. FIGS. 6, 7, 8 may have thicknesses of 200 Å, 510 Å and 250 Å, respectively, resulting in 13.8K, 4.2K and 17K ohm resistance, respectively. FIGS. 9 and 10 may have thicknesses of 250 Å and 200 Å, respectively resulting in 9.7K and 25K ohm resistance, respectively.

Figure 11:
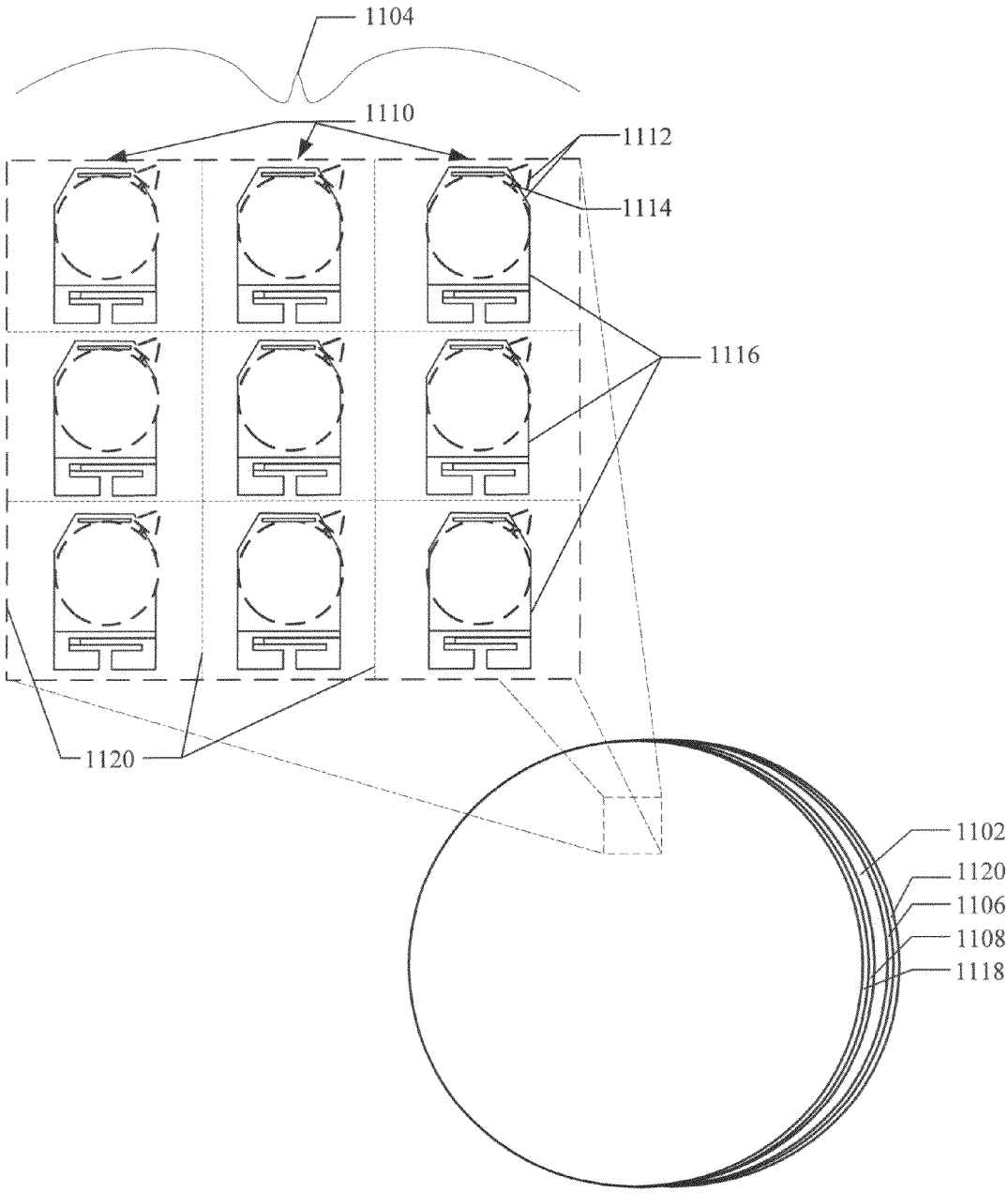
FIG. 11 is a plan view illustrating one embodiment of a plurality of vapor cells formed in a wafer.

The vapor cell illustrated in FIG. 1 may be formed and assembled in a variety of different processing steps. FIG. 11 illustrates one embodiment of multiple vapor cells with associated heaters assembled on a single wafer 1102 prior to dicing into individual vapor cells. An array 1104 of vapor cells are formed in the wafer 1102, preferably on an exit window 1106, and an entrance window 1108 is bonded to the wafer after the vapor cells are charged with a sample material (not shown). Each vapor cell 1110 in the array of vapor cells 1104 preferably has an interrogation cell-reservoir cell pair 1112 in vapor communication with each other through a trench 1114 or other pathway. In an alternative embodiment, the vapor cell does not have a reservoir cell, but rather the interrogation cell itself is charged with a sample material. Preferably, heaters 1116 are formed separately from the vapor cells 1110 on a heater substrate 1118. If heaters are provided on the exit window 1106, a separate heater substrate 1120 would be provided. After the vapor cells are charged and sealed with their respective transparent entrance and exit windows (1108, 1106), the heater substrate 1118 having the heaters 1116 is aligned with the array of vapor cells 1104 and bonded over the vapor cell assembly, such as by anodic bonding or adhesive bonding, to complete assembly of the vapor cells prior to dicing along dicing lines 1120. Alternatively, the heaters may be diced and be individually assembled onto the vapor cells.

While various embodiments of the invention have been described, it will be apparent to those of ordinary skill in the art that many more embodiments and implementations are possible within the scope of this invention.

We claim:

1. An apparatus, comprising:

an interrogation cell in a substrate, said interrogation cell having an entrance window and an exit window;

a first transparent thin-film heater in thermal communication with said entrance window and having proximal and distal ends, said transparent thin-film heater comprising:

a first layer in communication with a first pole contact at said proximal end and a layer coupler contact at said distal end;

a second layer in communication with a second pole contact at said proximal end, said second layer electrically coupled to said layer coupler contact at said distal end; and an insulating layer sandwiched between said first and second layers, said insulating layer having an opening at said distal end to admit said layer coupler contact and to insulate the remainder of said second layer from said first layer;

wherein said first and second pole contacts are available to complete an electric circuit at said proximal end, with magnetic fields for each of said first and second layers oriented in opposing directions when a current is applied through the circuit.

2. The apparatus of claim 1, further comprising a transparent heater substrate to support said first transparent thin-film heater and disposed on said entrance window.

3. The apparatus of claim 2, wherein said transparent heater substrate comprises borosilicate glass.

4. The apparatus of claim 3, wherein said entrance window comprises borosilicate glass.

5. The apparatus according to claim 1, further comprising:

a second transparent thin-film heater disposed over said exit window.

6. The apparatus of claim 1, wherein said first pole contact comprises:

a first pole pad; and a first pole distribution strip connected to said first pole pad and extending substantially along a proximal edge of said first layer.

7. The apparatus of claim 6, wherein said first pole pad and said first pole distribution strip each comprise a metal.

8. The apparatus of claim 6, wherein said second pole contact comprises:

a second pole pad; and a second pole distribution strip connected to said second pole pad and extending substantially along a proximal edge of said second layer.

9. The apparatus of claim 1, wherein said entrance window comprises borosilicate glass.

10. The apparatus of claim 1, wherein said entrance window and said exit window are on opposite sides of said substrate.

11. The apparatus of claim 1, further comprising a dielectric on said second layer to provide insulation for said second layer from the environment.

12. The apparatus of claim 1, wherein said first layer comprises a zinc-oxide layer.

13. The apparatus of claim 1, wherein said first layer comprises indium tin oxide.

14. A heater method, comprising:

driving a current through folded and directionally-opposite current paths in a transparent thin-film heater; and heating an entrance window of a vapor cell with heat generated from said multi-layer thin-film heater;

wherein said folded and opposing current paths reduce the magnetic field from what would otherwise exist in a vapor cell heater without the folded and stacked configuration of the multi-layer thin-film heater.

15. The method of claim 14, further comprising:

heating said entrance window uniformly.

16. The method of claim 14, further comprising:

heating said entrance window in an annular pattern.

17. The method of claim 14, further comprising:

heating an interior side of said entrance window to a temperature greater than that of interior walls of said vapor cell.

18. A vapor cell system, comprising:

a vapor cell in a substrate, said vapor cell having an interrogation cell window; and a multi-layer thin-film heater in thermal communication with said interrogation cell window, said multi-layer thin-film heater comprising a plurality of vertically stacked thin-film layers in serial communication to wrap respective current flows during operation of said multi-layer thin-film heater;

wherein said plurality of stacked thin-film layers produce a reduced external magnetic field during operation than what would otherwise exist without the stacked and serial configuration.

19. The system according to claim 18, further comprising:

a reservoir cell adjacent said interrogation cell window; and wherein said multi-layer thin-film heater heats an optical aperture of said interrogation cell window uniformly.

20. The system according to claim 18, wherein positionally adjacent vertically stacked thin-film layers induce directionally-opposite magnetic fields in response to a current.

* * * * *